US012773726B2

(12) United States Patent
Hong et al.

(10) Patent No.: US 12,773,726 B2
(45) Date of Patent: Oct. 27, 2026

(54) METHOD OF MAKING COPPER-NICKEL ALLOY FOAMS

(71) Applicant: CellMo Materials Innovation, Inc., Conroe, TX (US)

(72) Inventors: Kicheol Hong, Busan (KR); Hyeji Park, Seoul (KR); Sukyung Lee, Incheon (KR); Youngseok Song, Jeollabuk-do (KR); Gigap Han, Chungcheongnam-do (KR); Kyungju Nam, Seoul (KR); Heeman Choe, Conroe, TX (US)

(73) Assignee: CellMo Materials Innovation, Inc., Conroe, TX (US)

( * ) Notice: Subject to any disclaimer, the term of this patent is extended or adjusted under 35 U.S.C. 154(b) by 0 days.

(21) Appl. No.: 18/596,532

(22) Filed: Mar. 5, 2024

(65) Prior Publication Data

US 2024/0359232 A1 Oct. 31, 2024

Related U.S. Application Data

(62) Division of application No. 16/979,513, filed as application No. PCT/US2019/021704 on Mar. 11, 2019, now Pat. No. 11,919,080.

(Continued)

(51) Int. Cl.
*B22F 3/11* (2006.01)
*B22F 3/00* (2021.01)

(Continued)

(52) U.S. Cl.
CPC ..... *B22F 3/1143* (2013.01); *B22F 3/001* (2013.01); *C22C 9/06* (2013.01); *C22C 19/002* (2013.01);

(Continued)

(58) Field of Classification Search
CPC ..... B22F 1/09; B22F 1/14; B22F 1/17; B22F 9/082; B22F 10/34; B22F 1/05;

(Continued)

(56) References Cited

U.S. PATENT DOCUMENTS 9,114,457 B2 * 8/2015 Nabawy ..... C22C 21/00
2008/0031767 A1 2/2008 Naumann et al.

(Continued)

FOREIGN PATENT DOCUMENTS

CN 102649263 8/2012
WO WO-2017037482 A2 * 3/2017 ..... B01J 35/56

OTHER PUBLICATIONS

Hyungyung et al. ("Morphological Study of Directionally Freeze-Cast Nickel Foams."). (Year: 2016).*

(Continued)

*Primary Examiner* — Ricardo D Morales
(74) *Attorney, Agent, or Firm* — Aka Chan LLP

(57) ABSTRACT

The successful fabrication of alloy foam (or porous alloy) is very rare, despite their potentially better properties and wider applicability than pure metallic foams. The processing of three-dimensional copper-nickel alloy foams is achieved through a strategic solid-solution alloying method based on oxide powder reduction or sintering processes, or both. Solid-solution alloy foams with five different compositions are successfully created, resulting in open-pore structures with varied porosity. The corrosion resistance of the synthesized copper-nickel alloy foams is superior to those of the pure copper and nickel foams.

24 Claims, 13 Drawing Sheets

Related U.S. Application Data

(60) Provisional application No. 62/641,223, filed on Mar. 9, 2018.

(51) Int. Cl.

| | |
|---|---|
| ***B22F 3/10*** | (2006.01) |
| ***C22C 1/08*** | (2006.01) |
| ***C22C 9/06*** | (2006.01) |
| ***C22C 19/00*** | (2006.01) |

(52) U.S. Cl.
CPC ..... *B22F 3/10* (2013.01); *B22F 2302/25* (2013.01); *C22C 1/08* (2013.01)

(58) Field of Classification Search
CPC ..... B22F 10/28; B22F 10/36; B22F 10/366; B22F 2009/0836; B22F 2301/15; B22F 2301/205; B22F 2304/10; B22F 9/10; B22F 2998/10; B22F 2999/00; B22F 9/14; B22F 10/00; B23K 26/342; B23K 2103/14; B33Y 10/00; B33Y 40/10; B33Y 70/00; B33Y 50/02; B33Y 80/00; C22C 1/0433; C22C 1/0458; C22C 14/00; C22C 19/007; C22C 19/03; Y02P 10/25
See application file for complete search history.

(56) References Cited

U.S. PATENT DOCUMENTS

2016/0368047 A1* 12/2016 Bagge-Hansen ..... C22C 1/0466
2017/0025683 A1* 1/2017 Park ..... B22F 5/10

OTHER PUBLICATIONS

Jo, H., et al., "Morphological Study of Directionally Freeze-Cast Nickel Foams," Metallurgical and Materials Transactions E, Feb. 23, 2016, vol. 3, Issue 1, pp. 46-54.
Hyungyung J., et al., "Morphological Study of Directionally Freeze-Cast Nickel Foams," Metallurgical and Materials Transactions E, Feb. 23, 2016, 9 pages.
International Search Report, PCT Application PCT/US2019/021704, Jun. 11, 2019, 4 pages.
Eugenio, S. et al., Electrodeposition and characterization of nickel-copper metallic foams for application as electrodes for supercapacitors, J Appl Electrochem, Nov. 29, 2013, pp. 455-465, 44, 2014.
Ji, Keju, et al. Fabrication and electromagnetic interference shielding performance of open-cell foam of a Cu—Ni alloy integrated with CNTs, Applied Surface Science, May 19, 2014, pp. 351-356, 311 (2014) 351-356.

* cited by examiner

METHOD OF MAKING COPPER-NICKEL ALLOY FOAMS

CROSS-REFERENCE TO RELATED APPLICATIONS

This patent application is a divisional of U.S. patent application Ser. No. 16/979,513, filed Sep. 9, 2020, issued as U.S. Pat. No. 11,919,080 on Mar. 5, 2024, which is a section 371 national phase filing of PCT patent application PCT/US2019/021704, filed Mar. 11, 2019, which claims the benefit of U.S. patent application 62/641,223, filed Mar. 9, 2018.

BACKGROUND OF THE INVENTION

This invention relates to the field of materials and more specifically to a copper-nickel alloy foam and its fabrication.

Metal foams have much higher mechanical strength, stiffness, thermal and electrical conductivity and energy absorption ability than polymer foams; furthermore, they are generally more stable in harsh environments as well. As opposed to ceramic foams, they have a much higher ability to deform plastically and absorb energy. Traditionally, the use of metal foams was limited to structural applications that utilized sandwich panels with closed cells due to their light weight and excellent bending strength. With their open-pore structure, metal foams are also permeable and have a very high surface area, providing the essential characteristics for functional flow-through applications that involve surface reactions. Over the past decade, metal foams have undergone significant quality improvements (e.g., pore size control, metal selection, and sample size), and their use has been extended to advanced functional usage in a wide range of engineering applications such as battery electrodes, catalysts, heat exchangers, and filters.

Open-cell metal foams with three-dimensional (3-D) interconnected pore structures at the order of the tens of micrometer scale have been recently explored to utilize their greater surface area and the enhanced electrochemical reactions that take place on their surface. Nonetheless, there is another significant challenge to overcome. Most of the developed metal foams have been pure and unalloyed, and their usage has significantly restricted their practical applications due to their inherent weak strength, low hardness, and poor corrosion resistance and reliability of pure, alloyed metal. For example, load-bearing structural applications normally require carefully designed alloys and composites that have high strength and fracture toughness; however, the pure metal has inherently weak strength and hardness, and is thus unsuitable for structural applications. One good example is the poor corrosion resistance of pure nickel (Ni) for potential applications in a corrosive fuel cell device. Despite the excellent performance of open-cell pure nickel foam for use as the anode gas diffusion layer (GDL) of the membrane electrode assembly in a fuel cell, the suspect long-term reliability of the nickel foam GDL in the fuel cell may prevent its successful practical application due to its poor corrosion resistance in the sulfuric acid environment.

Alloying with another element can mitigate the major drawbacks of the pure metal foams, such as poor chemical resistance, oxidation, corrosion, and mechanical properties. A good example is the copper-nickel alloy, which possesses excellent corrosion resistance. The binary copper-nickel alloys have been widely used in mining, metallurgical, and chemical industries due to their high corrosion resistance, activity and stability, and excellent mechanical properties.

Moreover, they have received much attention for their excellent magnetic and thermo-physical properties; therefore, they have long been used in petrochemical engineering, nuclear industry, ocean vessel industry, electrode material, catalysts, and other related fields. In other words, the use of alloys can be advantageous not only for load-bearing but also functional applications.

Therefore, there is a need for improved metal foams, especially a copper-nickel alloy foam.

BRIEF SUMMARY OF THE INVENTION

A novel method of manufacturing three dimensionally (3-D) connected copper-nickel alloy foams with five different compositions are successfully fabricated using freeze casting, resulting in open-pore structures with varied porosity (from about 55 percent to about 75 percent). The alloy foams, with improved mechanical properties, can provide enhanced specific surface area and higher permeability than their bulk counterpart. This new class material design exhibits improved mechanical and corrosion properties for use in various structural (e.g., high-temperature structural materials) and functional (e.g., filters and energy materials) applications.

The successful fabrication of alloy foam (or porous alloy) is very rare, despite their potentially better properties and wider applicability than pure metallic foams. This patent describes the processing of three-dimensional copper-nickel alloy foams through a strategic solid-solution alloying method based on oxide powder reduction or sintering processes, or both. Solid-solution alloy foams with five different compositions are successfully created, resulting in open-pore structures with varied porosity (from about 55 percent to about 75 percent). The corrosion resistance of the synthesized copper-nickel alloy foams is superior to those of the pure copper and nickel foams.

For example, the weight loss rate of the Cu7Ni3 alloy foam is six times and five times slower than those of the pure copper and pure copper foams in a sulfuric corrosive environment, respectively. The strength and energy absorption capability also increases for copper-nickel alloy foams. The yield strength of Cu7Ni3 alloy foam (53 percent porosity plus or minus about 2 percent porosity) is 72 megapascals plus or minus about 2 megapascals and its yield strength when normalized by a Gibson-Ashby model was the largest with a value of up to 852 megapascals plus or minus about 3 megapascals. Energy absorbed by the foams during compression to a strain of 0.4 is higher for the Cu7Ni3, Cu5Ni5, and Cu5Ni5 alloy foams than the pure copper and nickel foams, which can be explained by their solid-solution alloying effects. The clastic modulus and hardness values are varied in the range of about 73.4-152.4 gigapascals and about 1.6-4.7 gigapascals, respectively, and they are all greater than those of pure copper and nickel foams. The processing insights obtained in this invention can also apply to other alloy foams that can form partial or complete solid solutions at elevated temperature.

A solid-solution copper-nickel alloy foam is obtained directly from a mixture of nickel and copper powders green body, which has never been previously reported. The corrosion resistance of the synthesized copper-nickel alloy foams is superior to those of the pure copper and nickel foams. For example, the weight loss rate of the Cu7Ni3 alloy foam is six times and five times slower than those of the pure nickel and pure copper foams in a sulfuric corrosive environment, respectively. In addition, the strength of the copper-nickel alloy foams is superior to those of the pure nickel and pure copper foams. The yield strength of the Cu7Ni3 alloy foam (53 percent porosity plus or minus about 2 percent porosity) is 72 megapascals plus or minus about 2 megapascals and the yield strength, when normalized by the Gibson-Ashby model, is the largest among all the five alloy foams and pure copper and nickel foams with a value of up to 852 megapascals plus or minus about 3 megapascals. The hardness and elastic modulus values are varied in the range of 73.4-152.4 gigapascals and 1.62-4.73 gigapascals, respectively, depending on the composition of the alloy foam.

A novel method of manufacturing solid-solution copper-nickel alloy foam is invented for use in advanced structural and functional applications such as high-temperature filters, electrodes, heat exchangers as well as advanced infiltrated structural composites. This novel powder-based processing method is based on a combination of powder mixing, reduction, and sintering of nanosized nickel oxide (NiO) and copper oxide (CuO). It consists of manufacturing nickel-oxide-copper-oxide (CuO—NiO) mixture green body with polyvinyl alcohol (PVA) binder with pore sizes ranging from several micrometers to a few tens of micrometers. The mixture of nickel oxide and copper oxide oxides were expected to be reduced to metallic nickel and copper under a hydrogen (H2) atmosphere at around 300 degrees Celsius with polyvinyl alcohol (PVA binder eliminated. Subsequently, the reduced pure and alloy green-body foams were sintered) at about 800-1000 degrees Celsius under a 5 percent argon, hydrogen gas mixture to achieve a chemically bonded structure with mechanical integrity.

This patent describes for the first time on the successful synthesis of copper-nickel alloy foams with various compositions using freeze casting, a processing method that is based on a combination of powder metallurgy and oxide reduction or sintering processes, or both. Their morphology and mechanical properties are compared with those of the pure copper and nickel foams synthesized using the same processing parameters. Furthermore, their corrosion resistances and electrical conductivities are also measured and compared with those of the pure copper and nickel foams.

Even though porous metals have attracted great attention for various applications, they possess only limited applicability in their pure form due to their inherently weak mechanical properties and poor corrosion resistance. A strategic alloying process can mitigate those drawbacks in pure metal foams. In this study, pure copper (Cu), pure nickel (Ni), and intermetallic alloy foams with five different compositions were successfully fabricated by an ice-templating process, resulting in open-pore structures with varied porosity (from about 55 percent to about 75 percent). Their varied morphologies and crystal sizes were compared, and the lattice parameters and crystal sizes were calculated. The corrosion resistance of the synthesized copper-nickel alloy foams was superior to those of the pure copper and nickel foams. The weight loss rate of the Cu7Ni3 alloy foam was six times and five times slower than those of the pure nickel and pure copper foams in a sulfuric corrosive environment, respectively. The yield strength of Cu7Ni3 alloy foam (53 percent porosity plus or minus about 2 percent porosity) was 72 megapascals plus or minus about 2 megapascals and its yield strength when normalized by a Gibson-Ashby model was the largest with a value of up to 852 megapascals plus or minus about 3 megapascals. The hardness and elastic modulus values were varied in the range of 73.4-152.4 gigapascals and 1.62-4.73 gigapascals, respectively, depending on the composition of the alloy foam.

Other objects, features, and advantages of the present invention will become apparent upon consideration of the following detailed description and the accompanying drawings, in which like reference designations represent like features throughout the figures.

DETAILED DESCRIPTION OF THE INVENTION

Manufacturing the porous foam structure includes the steps: (a) preparing a mixture of nickel oxide and copper oxide powder slurry mixed with polyvinyl alcohol binder (PVA binder) and water; (b) adding Darvan 811 (a low-molecular-weight sodium polyacrylate powder dispersant) as a dispersant; (c) dispersing the slurry by stirring for about 30 minutes and then by sonication for about 1 hour; (d) freezing the powder slurry when placed in a mold in contact with the cold surface of a copper rod; (c) sublimating the frozen slurry under reduced pressure and low temperature, forming a porous CuO—NiO foam green body; (f) sintering and nitriding the porous CuO—NiO foam green body at a low temperature of about 250 to 300 degrees Celsius and then maintaining at that temperature for about 2 to 3 hours to remove the binder and reduce the oxide, and subsequently sintering under a 5 percent argon, hydrogen gas mixture at the high temperature of about 800 Celsius to about 1000 degrees Celsius for about 3 hours to about 8 hours to create copper-nickel alloy foams.

This patent describes a three-dimensionally (3-D or 3D) connected porous structure of the copper-nickel foam created from the combination of the slurry freezing or sintering, or both, and their solid-solution alloying mechanism between copper and nickel during sintering can be used as an advanced material, which can provide higher surface area with decent mechanical and corrosion properties for potential use in various high-temperature structural and functional applications.

This patent describes the combination of the slurry freezing or sintering, or both, and the solid-solution mechanism between copper and nickel as a unique combination, which can be applied to other metallic alloys with the same chemical characteristic of solid-solution formation at elevated temperatures. In other words, a copper-nickel alloy foam is used as a model material to demonstrate a new facile invention of synthesizing solid solution alloy foams using freeze casting; however, the fundamental insights obtained in this invention can also apply more broadly to other alloy foams that can form partial or complete solid solutions.

Based on the solid-solution alloying mechanism, alloy foams with different ratios of copper and nickel can be produced. For example, Cu9Ni1, Cu7Ni3, Cu5Ni5, Cu3Ni7, and Cu1Ni9 alloy foams can be created using a technique as described in this patent.

Figure 1:
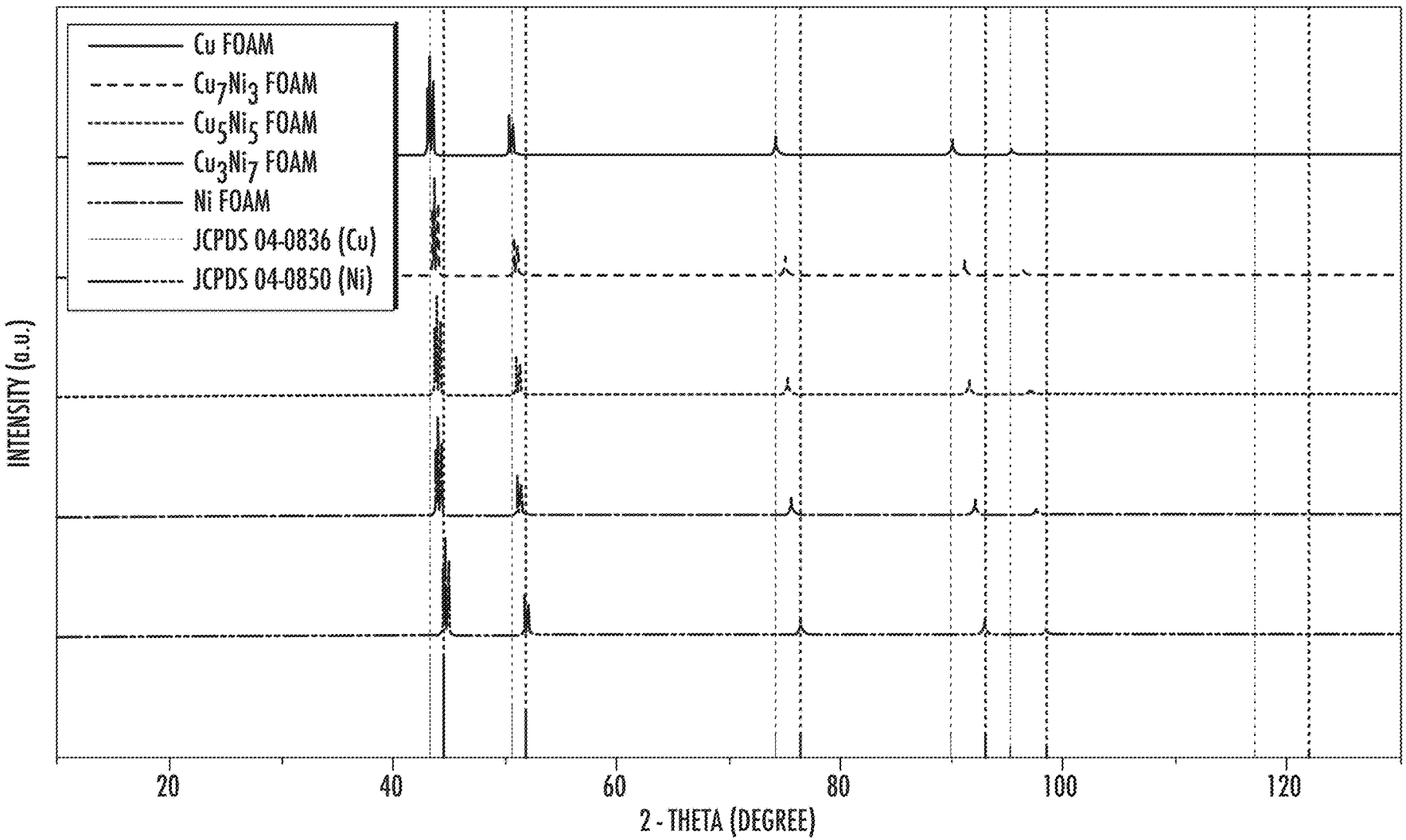
FIG. 1 shows a comparison of XRD patterns of the copper-nickel alloy foams with various compositions.

FIG. 1 shows a comparison of XRD patterns of the copper-nickel alloy foams with various compositions.

Figure 2:
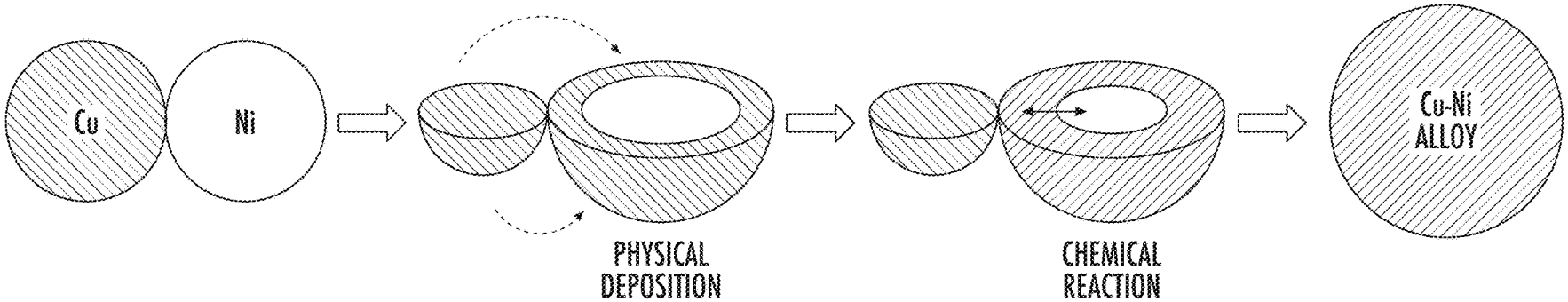
FIG. 2 shows a schematic diagram of the alloy formation mechanism in the copper-nickel solid-solution system.

FIG. 2 shows a schematic diagram of the alloy formation mechanism in the copper-nickel solid-solution system.

Figure 3:
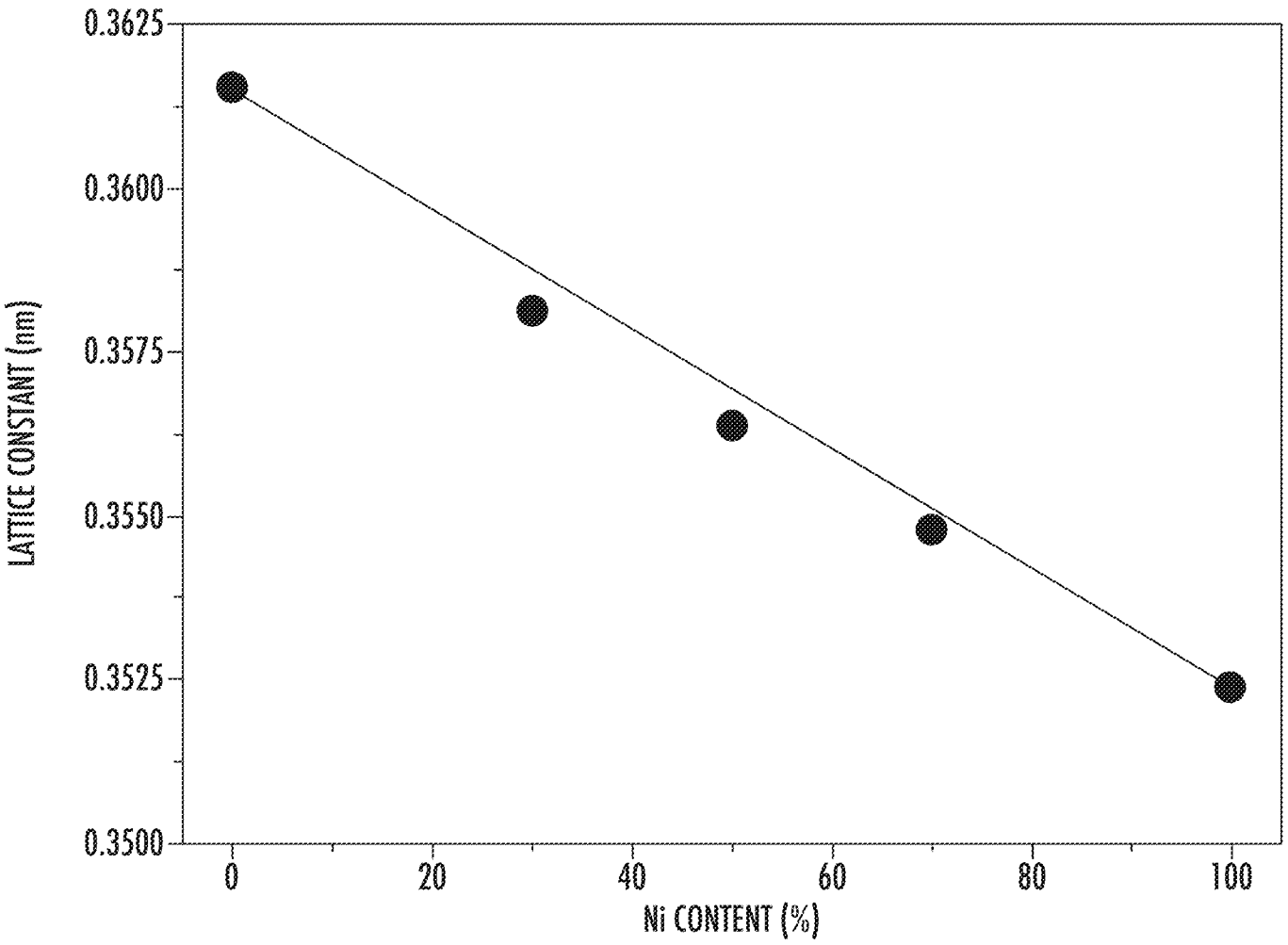
FIG. 3 shows a variation of lattice constant determined by XRD versus the nickel content of the foams.

FIG. 3 shows a variation of lattice constant determined by XRD versus the nickel content of the foams.

Figure 4:
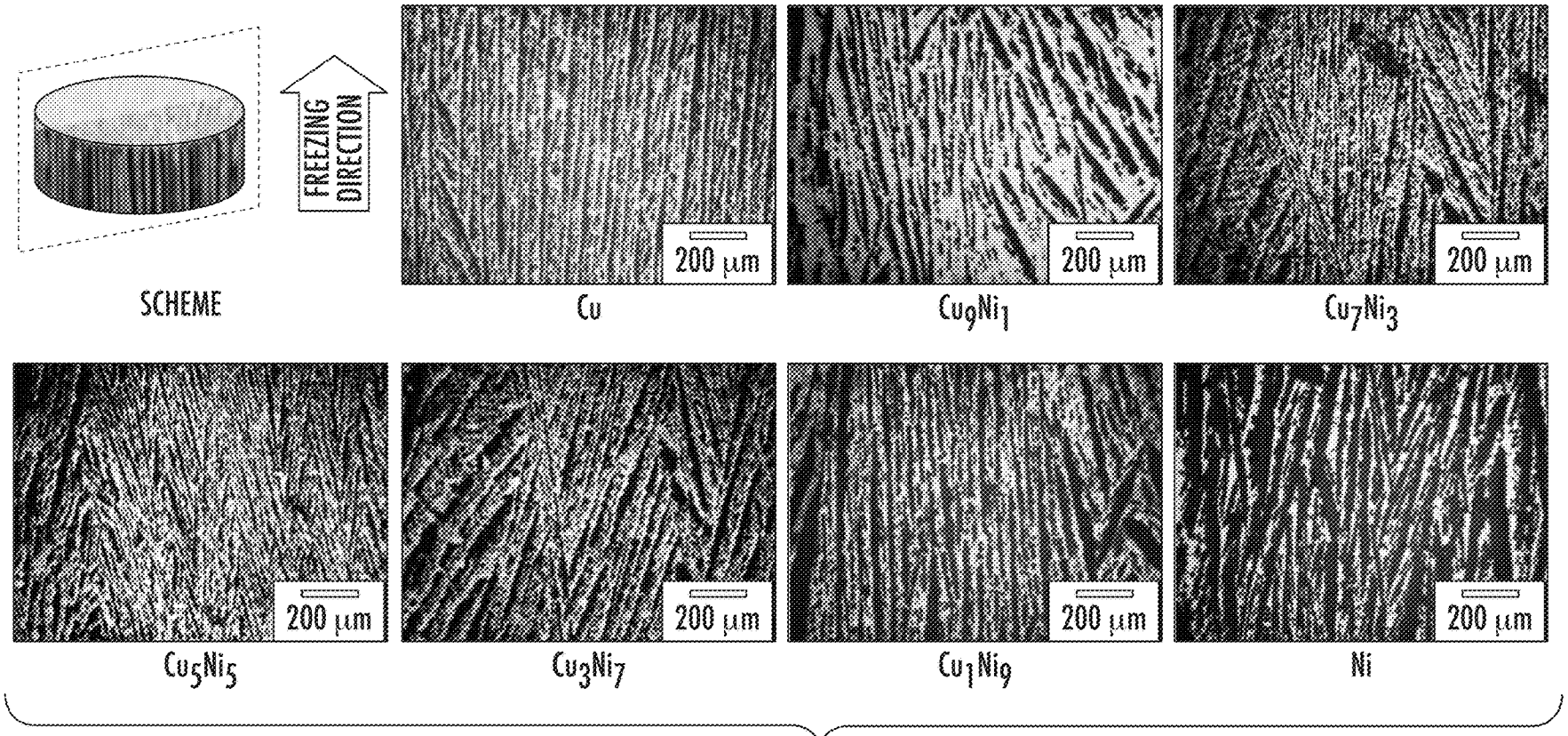
FIG. 4 shows optical micrographs of cross-sections parallel to the freezing direction for copper-nickel alloy foams with varying compositions exhibiting the lamellar macropore structure and copper-nickel strut walls.

FIG. 4 shows optical micrographs of cross-sections parallel to the freezing direction for copper-nickel alloy foams with varying compositions exhibiting the lamellar macropore structure and copper-nickel strut walls.

Note that each strut wall contains asymmetric micropores (formed only on one side) and, to a lesser extent, within their volumes. The green-body foams were first heated to about 250-300 degrees Celsius in a furnace and then maintained at the temperature for about 2-3 hours to burn off the binder and reduce the oxides to metals. They were then subsequently sintered at about 800 degrees Celsius, 900 degrees Celsius, or 1000 degrees Celsius under a 5 percent argon, hydrogen gas mixture depending on the composition of the slurry.

Figure 5:
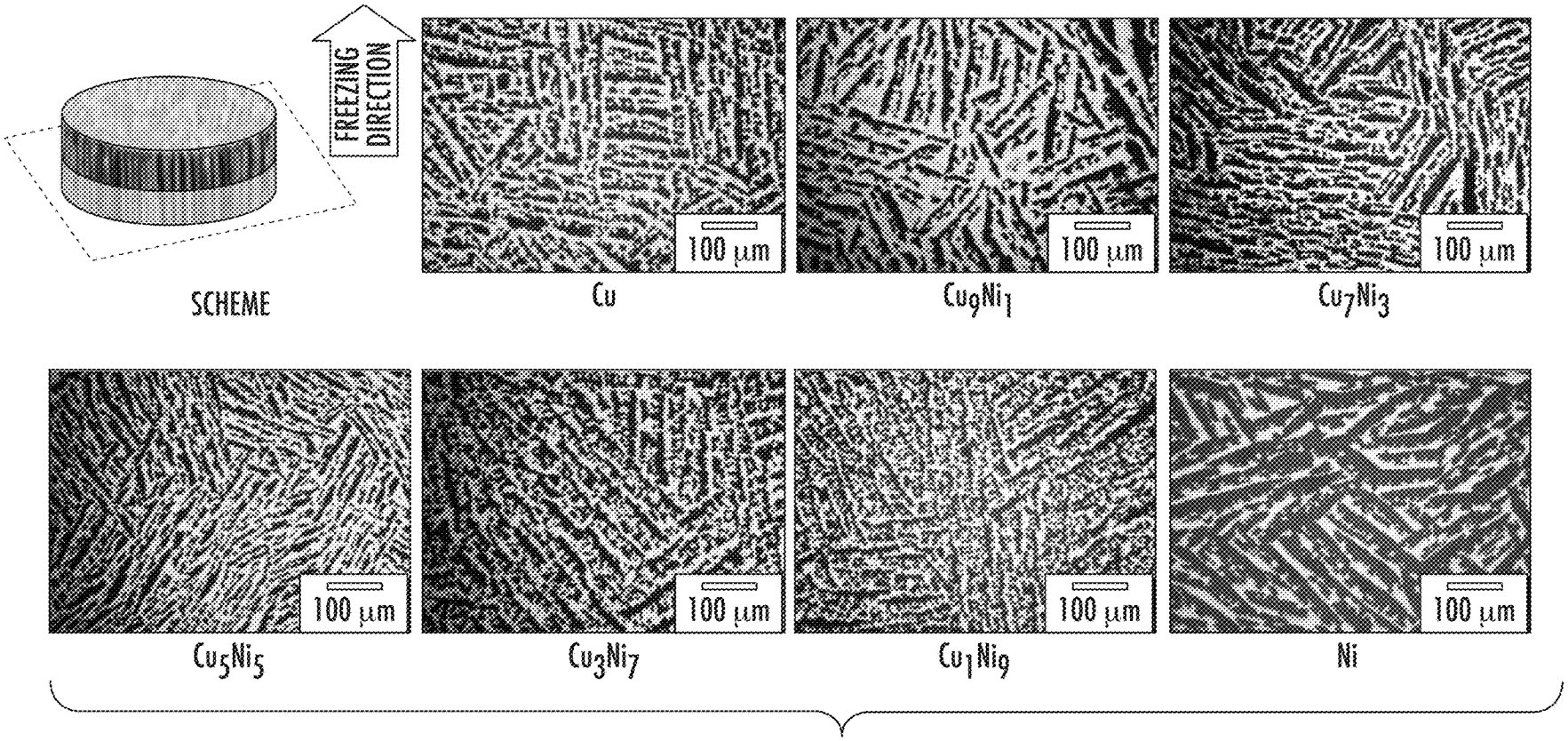
FIG. 5 shows optical micrographs of cross-sections perpendicular to the freezing direction for copper-nickel alloy foams with varying compositions.

FIG. 5 shows optical micrographs of cross-sections perpendicular to the freezing direction for copper-nickel alloy foams with varying compositions. The green-body foams were first heated to about 250-300 degrees Celsius in a furnace and then maintained at the temperature for about 2-3 hours to burn off the binder and reduce the oxides to metals. They were then subsequently sintered at about 800 degrees Celsius, 900 degrees Celsius, or 1000 degrees Celsius under a 5 percent argon, hydrogen gas mixture depending on the composition of the slurry.

Figure 6A:
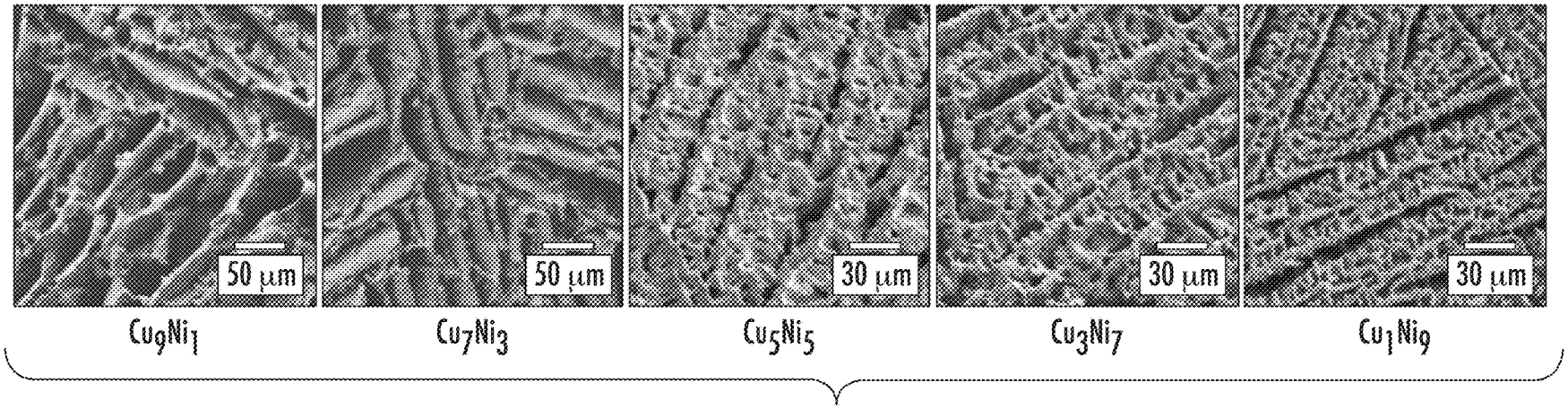
FIG. 6A shows SEM images of the as-cast top morphology of freeze-cast copper-nickel alloy foams with varying compositions showing a hierarchical pore structure (macro lamellar pores and asymmetric micropores).

FIG. 6A shows SEM images of the as-cast top morphology of freeze-cast copper-nickel alloy foams with varying compositions showing a hierarchical pore structure (macro lamellar pores and asymmetric micropores).

Figure 6B:
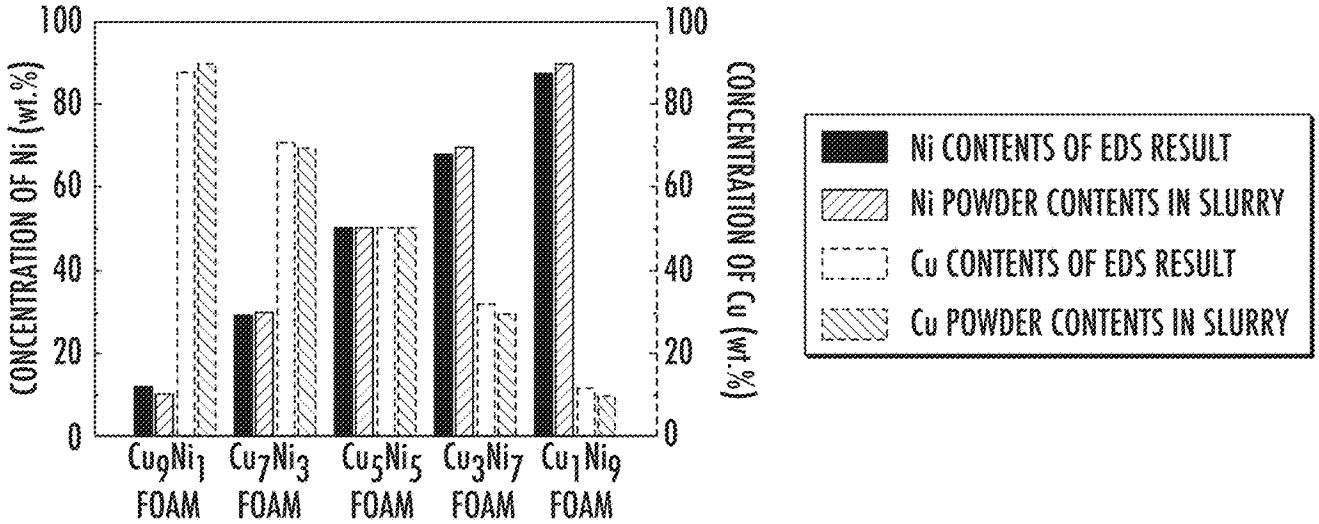
FIG. 6B shows variations of copper and nickel compositions measured by EDS in comparison with the initial copper and nickel powder compositions in the slurry.

FIG. 6B shows variations of copper and nickel compositions measured by energy-dispersive X-ray spectroscopy (EDS) in comparison with the initial copper and nickel powder compositions in the slurry.

FIGS. 7A-7E show SEM images of grain structures in struts of foams of different chemical compositions.

Figure 8:
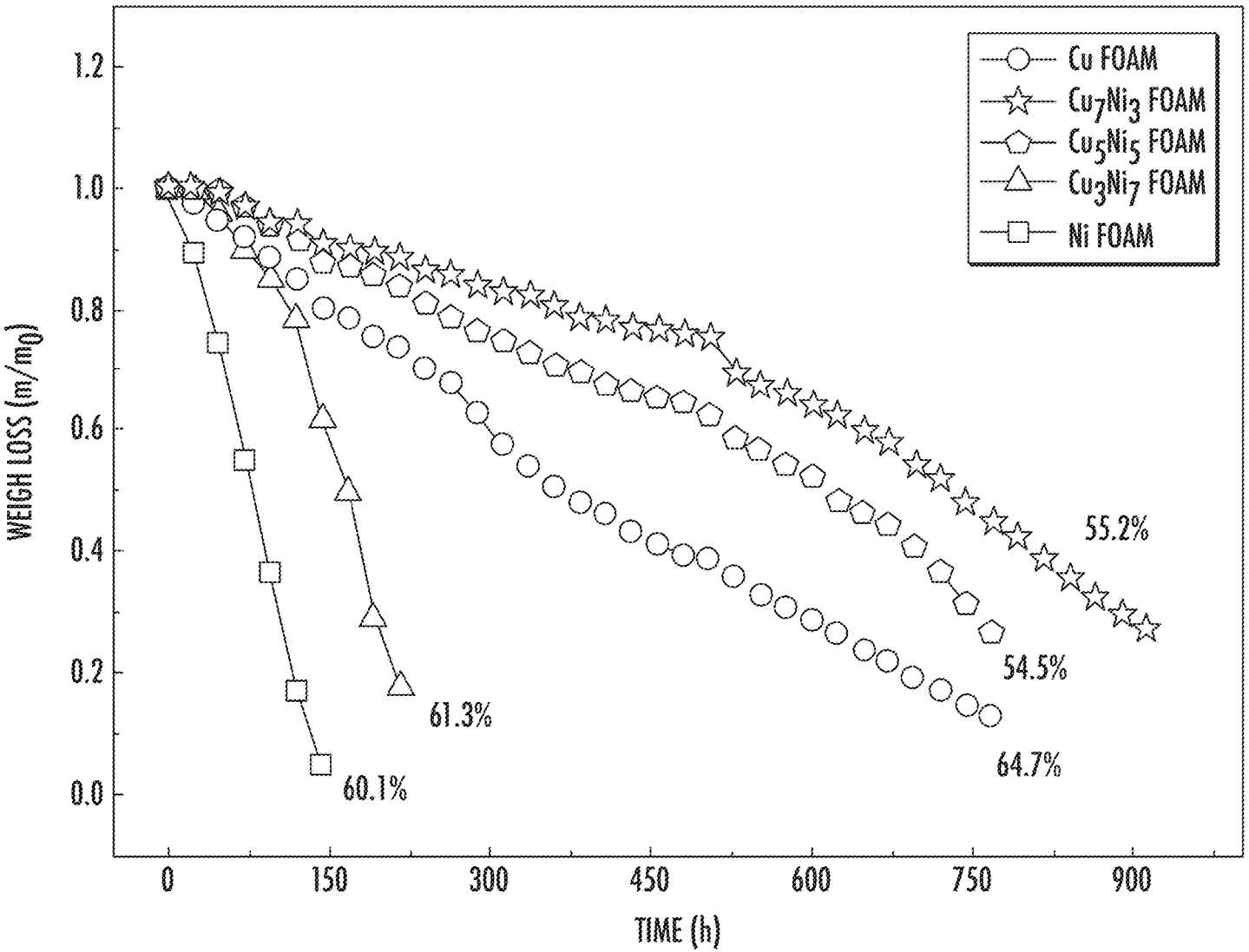
FIG. 8 shows a comparison of the corrosion resistance of copper, Cu3Ni7, Cu5Ni5, Cu7Ni3, and nickel foams as a function of the weight loss with increasing time.
Figure 9A:
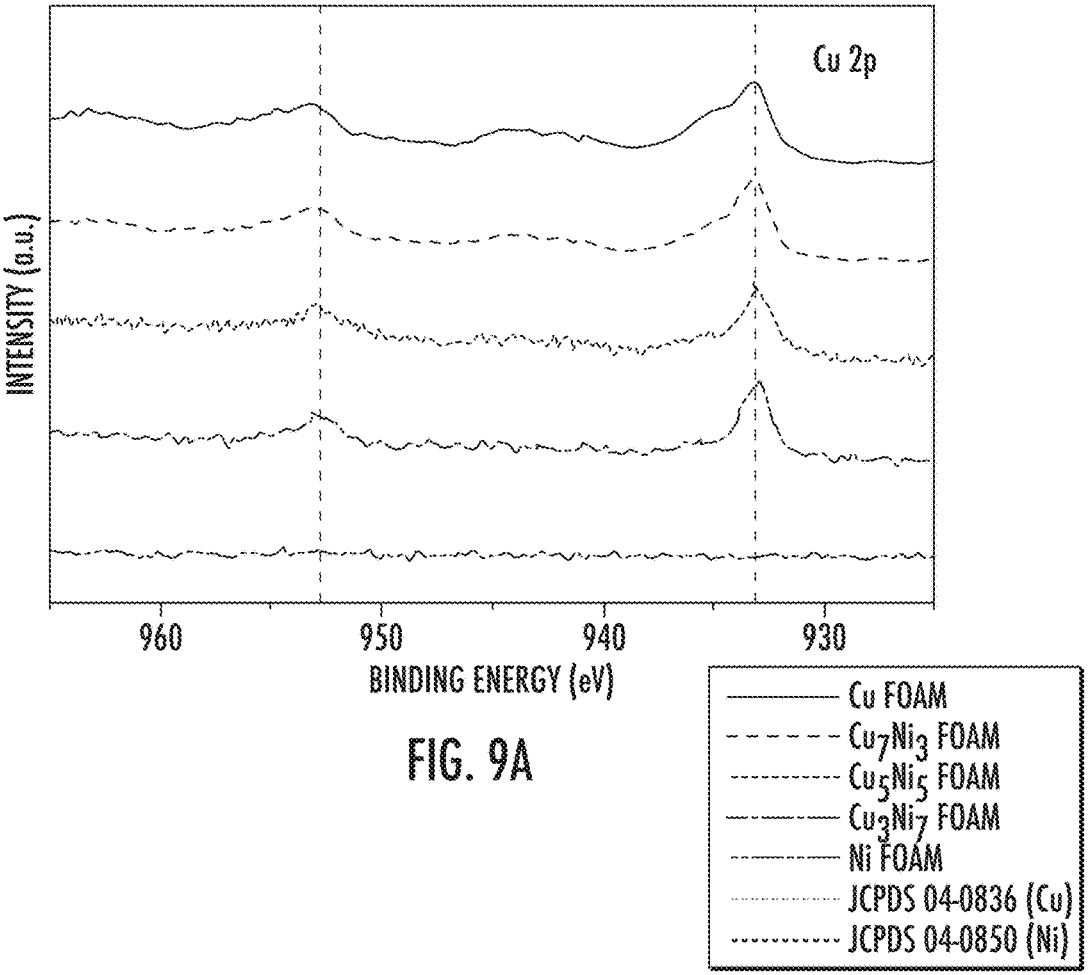
FIGS. 9A-9D show (9A) XPS Cu 2p and (9B) Ni 2p spectra of the Cu, Cu3Ni7, Cu5Ni5, Cu7Ni3, and nickel foams in comparison with (9C) XPS Cu 2p and (9D) Ni 2p spectra of the Cu, Cu3Ni7, Cu5Ni5, Cu7Ni3, and nickel foams after etching.
Figure 9B:
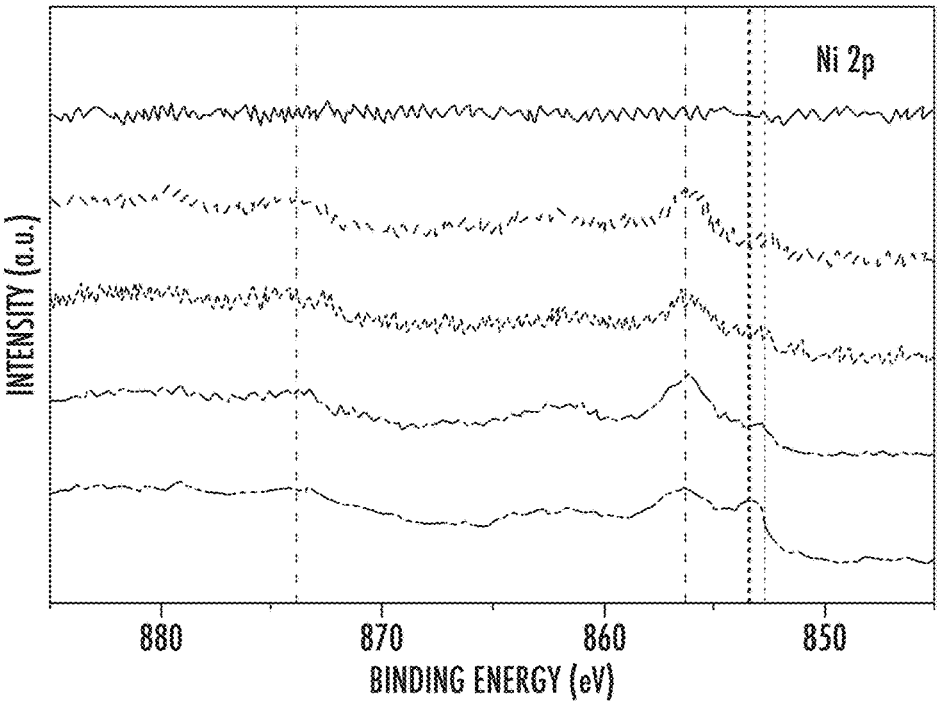
Figure 9C:
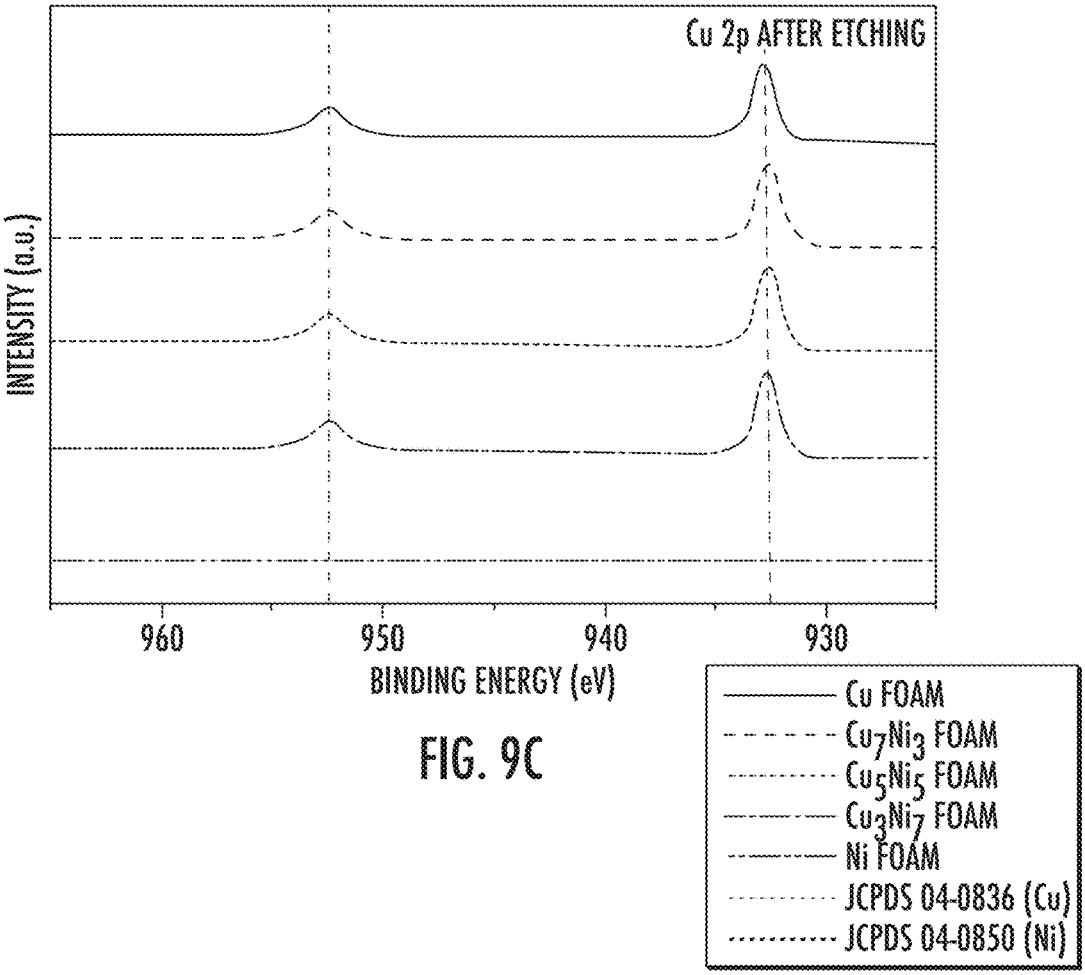
Figure 9D:
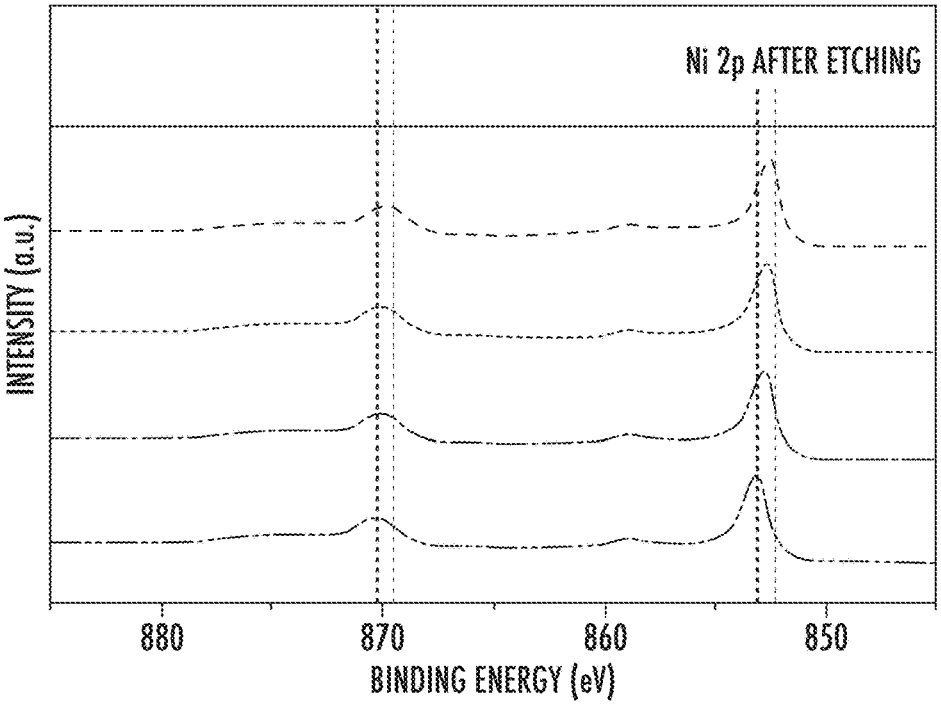

FIG. 8 shows a comparison of the corrosion resistance of copper, Cu3Ni7, Cu5Ni5, Cu7Ni3, and nickel foams as a function of the weight loss with increasing time in the still sulfuric environment of a diluted H2SO4 pH1 solution at about 70-80 degrees Celsius for 30 days. The values next to the graphs represent the porosity of the alloy foams.

FIGS. 9A-9D show (9A) XPS Cu 2p and (9B) Ni 2p spectra of the Cu, Cu3Ni7, Cu5Ni5, Cu7Ni3, and nickel foams in comparison with (9C) XPS Cu 2p and (9D) Ni 2p spectra of the Cu, Cu3Ni7, Cu5Ni5, Cu7Ni3, and nickel foams after etching (removing the native oxides by argon sputtering).

Figure 10A:
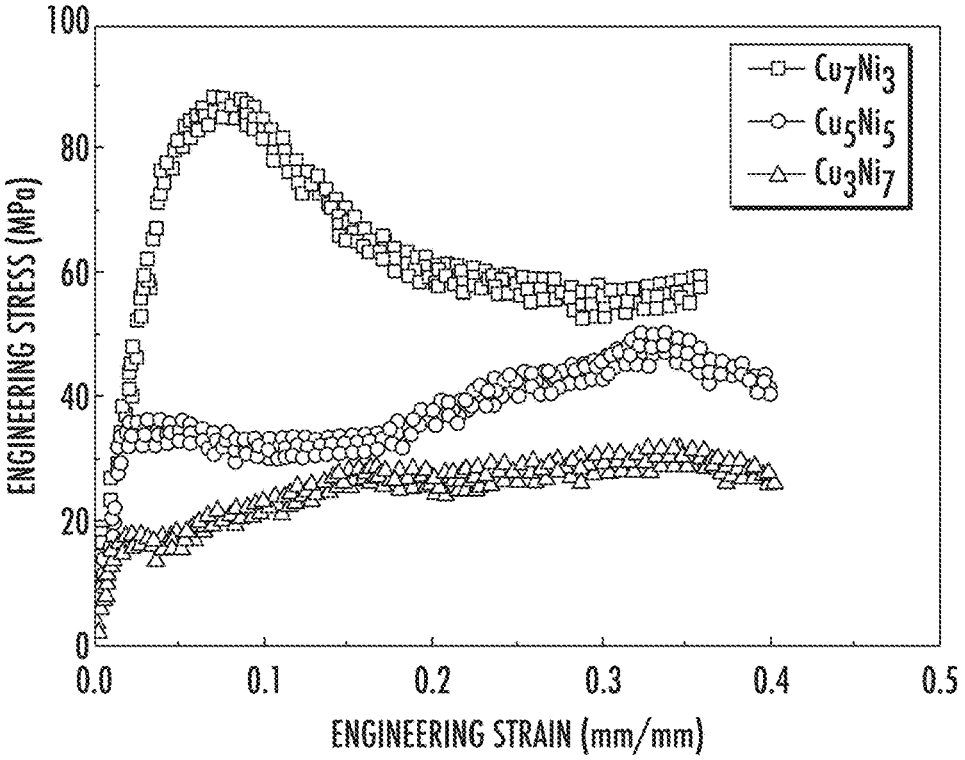
FIGS. 10A-10B show a comparison of (10A) compressive stress-strain curves of three representative copper-nickel alloy foam specimens and (10B) compressive stress-strain curves of the three copper-nickel alloy foam specimens normalized.
Figure 10B:
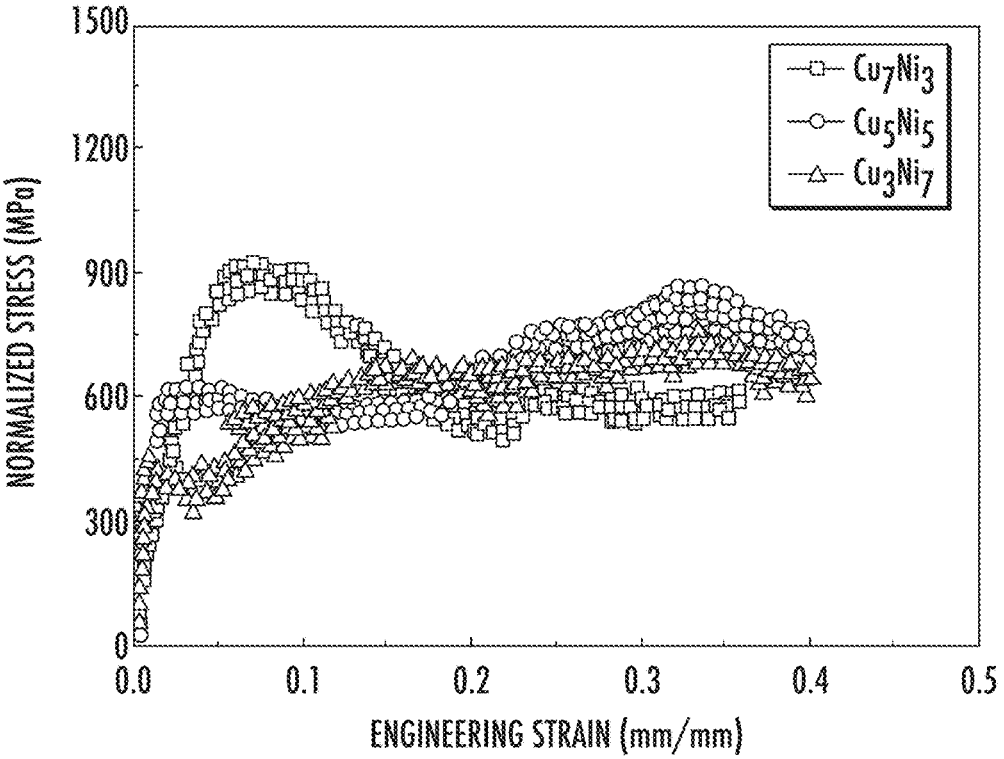

FIGS. 10A-10B show a comparison of (10A) compressive stress-strain curves of three representative copper-nickel alloy foam specimens (Cu3Ni7, Cu5Ni5, and Cu7Ni3) with about 53-73 percent porosity and pores oriented parallel to the compressive loading direction and (10B) compressive stress-strain curves of the same three copper-nickel alloy foam specimens normalized by $\sigma/(A(\rho^*)1.5)$ to exclude the effect of the porosity.

Figure 11:
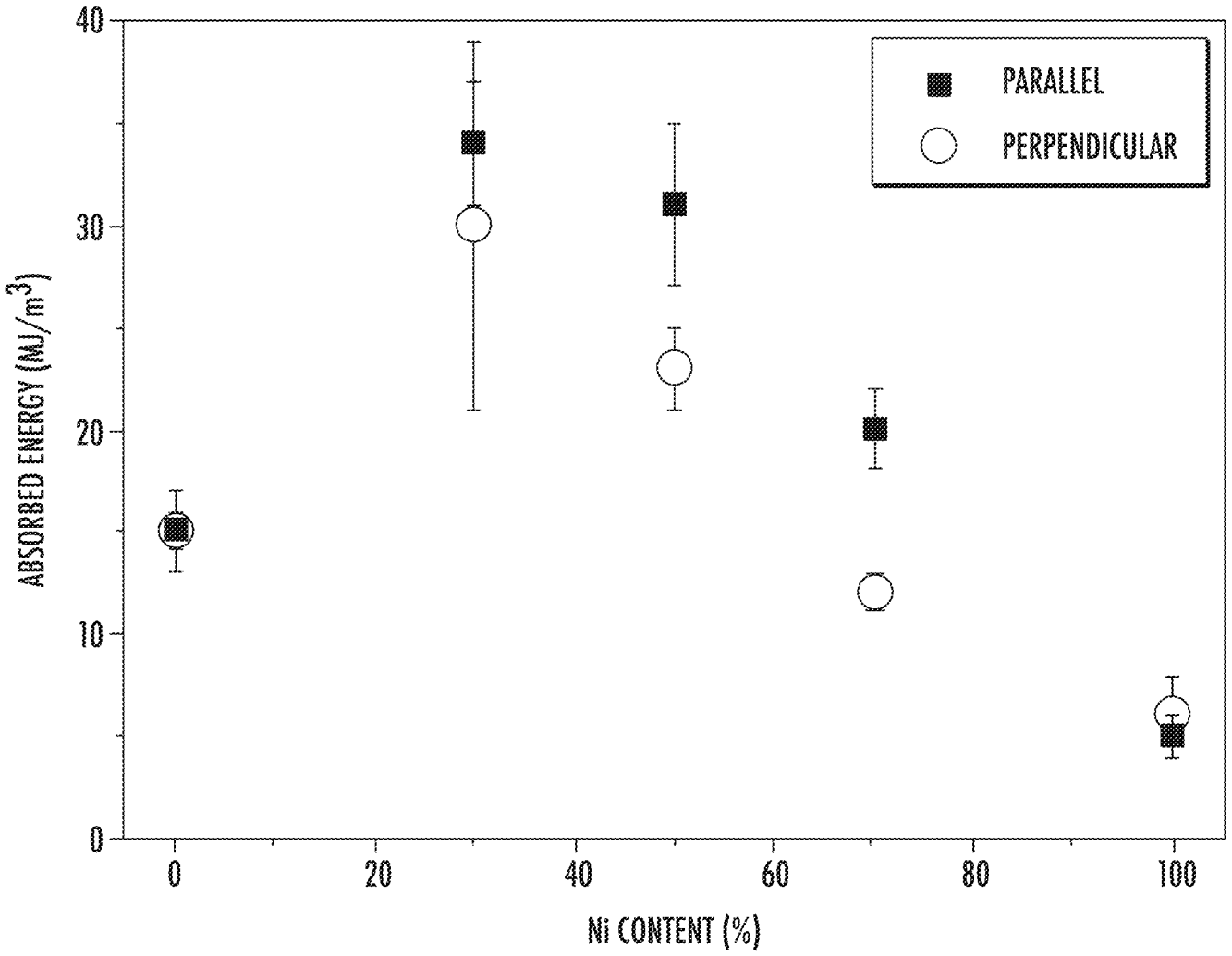
FIG. 11 shows an energy absorbed in the foams during compression to the strain of 0.4 for the freeze-casted copper-nickel foams as a function of the nickel content.

FIG. 11 shows an energy absorbed in the foams during compression to the strain of 0.4 for the freeze-casted copper-nickel foams as a function of the nickel content.

Figure 12A:
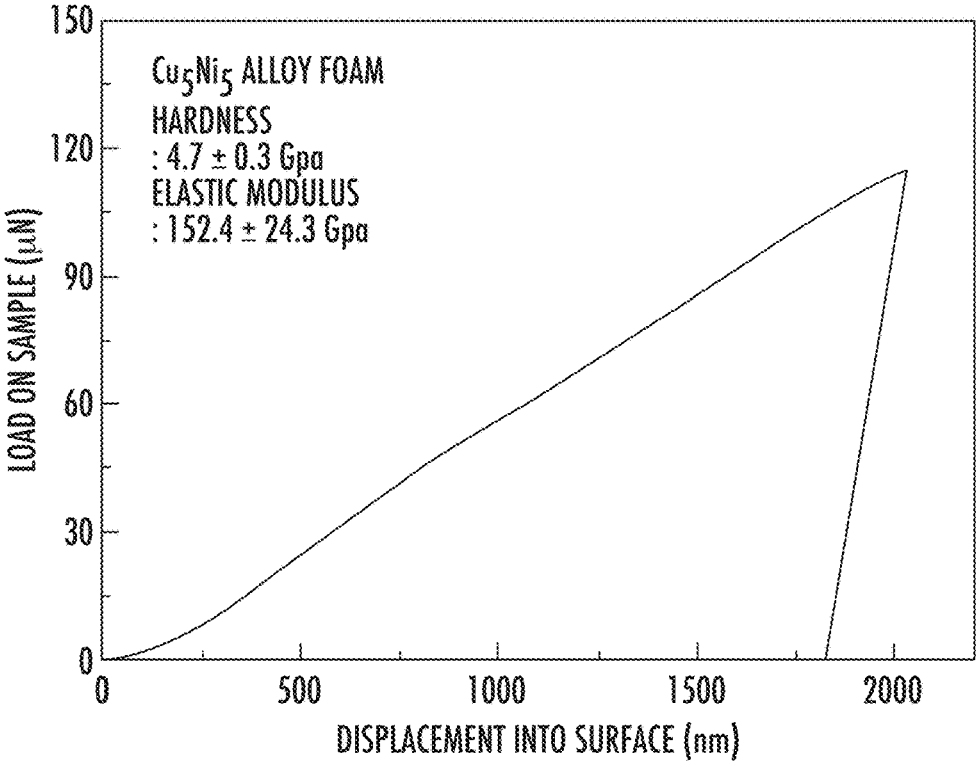
FIGS. 12A-12B show nanoindentation test results for the copper-nickel alloy foams: (12A) a representative load-displacement curve with a peak load of 123.76 micronewtons and (12B) variations of hardness and elastic modulus values of the copper-nickel alloy foams with an increasing composition of nickel.
Figure 12B:
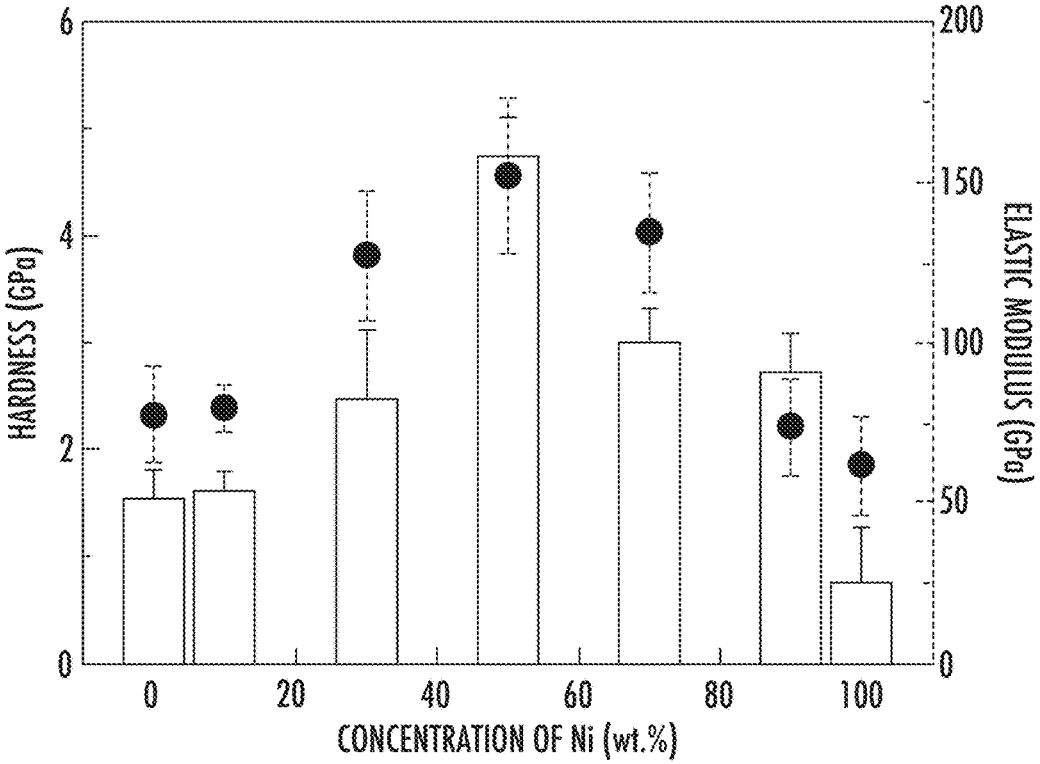

FIGS. 12A-12B show nanoindentation test results for the copper-nickel alloy foams: (12A) a representative load-displacement curve with a peak load of 123.76 micronewtons and (12B) variations of hardness and elastic modulus values of the copper-nickel alloy foams with an increasing composition of nickel.

Exemplary Embodiment 1: Synthesizing Copper-Nickel Alloy Foams

Nickel oxide powder (NiO, with an average particle size less than about 20 nanometers) and copper oxide powder (CuO, with a particle size of about 40 nanometers to about 80 nanometers) are used to fabricate copper-nickel alloy foams. First, a mixture of 3 weight-percent polyvinyl alcohol binder (PVA binder with molecular weight of about 89,000-98,000 gram per molar) and distilled water is prepared and subsequently heated up to 80 degrees Celsius to dissolve the binder. Various weight ratios of copper and nickel powders are then suspended in the prepared solution to obtain copper-nickel slurries with various compositions. To improve the stability of the suspension, 0.09 grams of Darvan 811 (a low-molecular-weight sodium polyacrylate powder dispersant) is also added as a dispersant. The slurry solution is then dispersed first by stirring for about 30 minutes and then by sonication for about 1 hour. To ensure sufficient particle dispersion, this process is repeated twice.

The copper rod is cooled using liquid nitrogen and controlled using a thermocouple and temperature controller. Once the freezing process is complete, the frozen green-body CuO—NiO foam sample is removed from the mold and sublimated at about 185 Kelvin (−88 degrees Celsius) for about 48 hours in a freeze-dryer under a 0.005-torr residual atmosphere.

The green-body foam is then heat-treated in two steps. First, it is heated to about 250-300 degrees Celsius in a furnace and then maintained at this temperature for about 2 hours to about 3 hours to burn off the binder and reduce the oxides to metals. It is then subsequently sintered at about 800 degrees Celsius, 900 degrees Celsius, or 1000 degrees Celsius under a 5 percent argon, hydrogen gas mixture depending on the composition of the slurry. Heating rates were about 5 degrees Celsius per minute and the final cooling rate was about 3 degrees Celsius per minute. The sintered copper-nickel alloy foam samples containing 100, 90, 70, 50, 30, 10 and 0 weight-percent copper are denoted as copper, Cu9Ni1, Cu7Ni3, Cu5Ni5, Cu3Ni7, Cu1Ni9, and nickel, respectively.

Exemplary Embodiment 2: Phase Analysis, and Corrosion and Mechanical Properties of the Synthesized Copper-Nickel Alloy Foams To confirm the complete transformation of porous CuO—NiO into copper-nickel alloy foam, an X-ray powder diffraction (XRD) analysis was carried out. FIG. 1 compares the XRD patterns of the prepared CuO—NiO foam green body and synthesized copper-nickel alloy foam, before and after the simultaneous reduction or sintering process, or both, in a box furnace under a 5 percent argon, hydrogen gas atmosphere. The XRD patterns confirmed that the starting CuO—NiO powder was completely transformed to the combination of copper-nickel phases based on their high-temperature solid-solution alloying mechanism (FIG. 2), as seen from the XRD patterns of the final synthesized copper-nickel alloy foams.

FIG. 3 shows the lattice constant determined by XRD versus the nickel content of the foams for the three different alloy foams and two pure foams of copper and nickel. In addition, the straight line represents the theoretical variation of the lattice parameter as a function of nickel concentration in copper-nickel solid-solution alloy foams. It can be seen that the measured lattice constants were very close to the theoretical values, suggesting that the material in the struts was a solid solution for all created alloy foams. This result is also supported by the lack of the peaks of other phases in the XRD patterns (FIG. 1).

FIGS. 4 and 5 show the optical images of copper-nickel foams' cross sections that are cut parallel (FIG. 4) or perpendicular (FIG. 5) to the freezing direction. All samples show dendritic walls with thickness in the order of about 0.60-1.45 microns (see FIG. 4). Notably, the morphology of the pure nickel foam is influenced not only by the nucleation conditions, but also by the solidification kinetics. After the randomly oriented rapid growth of the ice crystals near the contact point of the copper rod, a single solidification front consisting of numerous grains grows along the temperature gradient, which subsequently leads to an oriented and continuous lamellar dendrite morphology in both parallel and perpendicular directions to the ice front; the optical images of the cross-sections in FIG. 4 show the representative areas of the middle sections along the temperature gradient. The morphology of the vertically aligned, lamellar macro-pores replicating ice dendrite colonies are seen to have directional growth during freezing as a result of the higher growth velocity in the parallel direction rather than perpendicular to the temperature gradient (FIG. 5).

FIGS. 6A-6B show (6A) SEM images and (6B) EDS analysis results of the five copper-nickel alloy foams with varying ratios of copper and nickel. Based on the EDS analysis in FIG. 6B, all of the five alloy foams were confirmed to be successfully alloyed with the intended compositions of copper and nickel. Scanning electron microscope (SEM) images show different morphologies with varied compositions. The wall width of the alloy foams gradually increased from about 0.6 microns to about 1.36 microns with increasing nickel content because of the stronger particle-particle interaction of nickel atoms during the reduction and sintering process; in other words, the surface energy of nickel is greater than that of copper, resulting in stronger particle-particle interaction and denser walls. Another possible cause may be the considerable size difference between the initial powders of nickel oxide (e.g., less then 20 nanometers) and copper oxide (e.g., about 40-80 nanometers), resulting in more uniform dispersion and packing of the smaller nickel oxide particles in the prepared slurry.

Figure 7A:
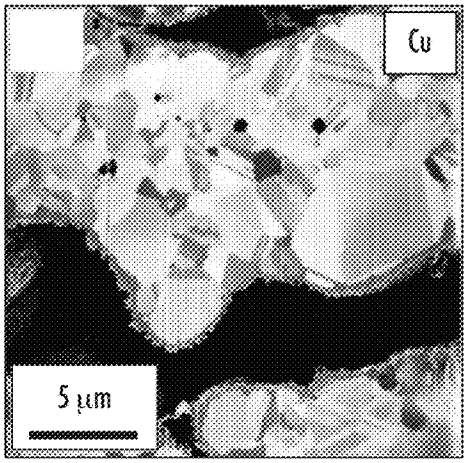
FIGS. 7A-7E show SEM images of grain structures in struts of foams of different chemical compositions.
Figure 7B:
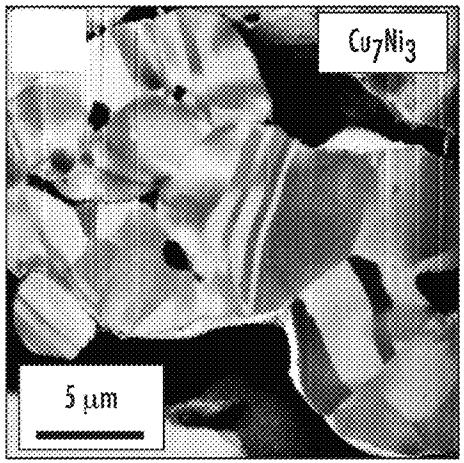
Figure 7C:
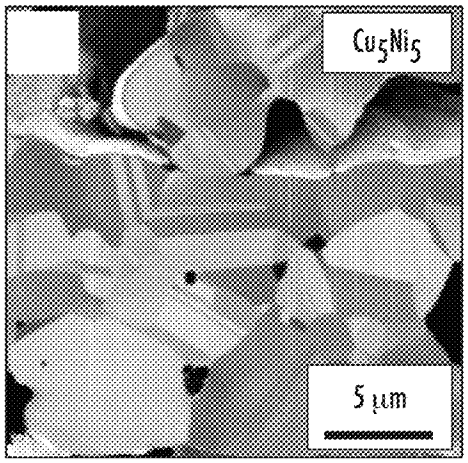
Figure 7D:
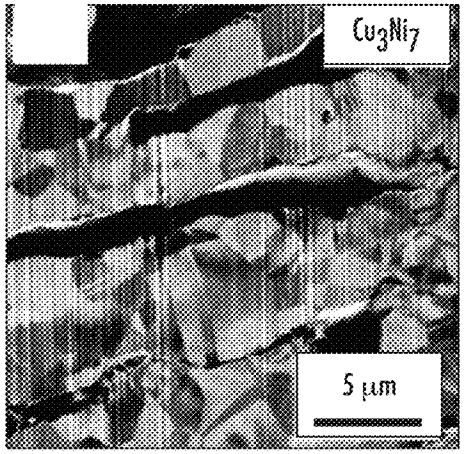
Figure 7E:
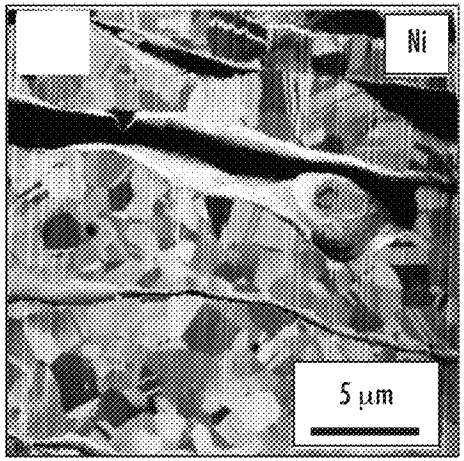

FIGS. 7A (Cu), 7B (Cu7Ni3), 7C (Cu5Ni5), 7D (Cu3Ni7), and 7E (Ni) show SEM images of grain structures in struts of foams of different chemical compositions. The thin vertical lines on the images indicate wavy surfaces caused by the focused ion beam (FIB)-cutting process and referred to as the "curtaining" effect in the literature. The grains had sizes of between about 1 and 5 microns for all of the samples. Twins were frequently observed inside the grains, some of which had wavy shapes due to the "curtaining" effect. The mean grain sizes varied between about 1 and 2.8 microns for the different copper-nickel foams. It is evident that although there was no correlation between the chemical composition and the grain size for the created alloy foams, the pure metals had a smaller grain size than the alloy foams.

FIG. 8 shows the weight loss behaviors of the pure nickel and copper foams in comparison with those of the Cu7Ni3, Cu5Ni5, and Cu3Ni7 alloy foams. The Cu7Ni3 alloy foam showed the best corrosion resistance in sulfuric acid (H2SO4) solution, followed by Cu5Ni5, pure copper, Cu3Ni7 and pure nickel foams in the order listed. The Cu7Ni3 alloy foam with the best corrosion resistance suffered only about a 19.5 percent decrease after about 360 hours and about a 35.8 percent decrease after about 600 hours.

Contrary to the superior corrosion performance of bulk pure nickel and copper-nickel alloys with more than 30 percent nickel contents in sulfuric acid solution due to the formation of a passive film, the pure nickel foam sample in this study manifested the poorest stability in the sulfuric acid corrosive condition and was completely dissolved after about 150 hours (FIG. 8). The weight loss rate of the three different alloy foams also tended to be in proportion to the nickel content.

Two microstructural factors may be considered for this explanation. First, the amount of porosity may have contributed to the corrosion weight loss because higher porosity implies a greater surface area, providing a greater reaction area. Second, the morphology of strut walls and pores may have also contributed to the corrosion weight loss, as the pure nickel and copper-nickel alloy foams with higher nickel contents tend to exhibit finer strut and pore structure with a greater surface area (see SEM images of Cu3Ni7 and Cu1Ni9 foams in FIG. 6A) than pure copper and copper-nickel foams with lower nickel content; this finer strut and pore structure probably resulted from the much smaller initial powder size of nickel oxide (e.g., less than 20 nanometers).

To understand the high corrosion resistance of some copper-nickel alloy foams, X-ray photoelectron spectroscopy (XPS) analysis was also carried out. Based on the XPS Cu 2p and Ni 2p spectra displayed in FIGS. 9A and 9B, respectively, it was observable that nickel at the surface of the alloy foams were more significantly oxidized compared to that of the nickel foam, while copper in the alloy foams showed lower degree of oxidation than that in the copper foam.

The copper oxide signal roughly located at 935 electron volts (eV) belonged to the copper foam and its magnitude apparently decreased in the alloy foams. On the other hand, the peak of the metallic nickel at around 853 electron volts was indeed smaller in the alloy foams compared to that in the nickel foam. To further understand the electronic interaction between copper and nickel in the alloy foams, the XPS Cu 2p and Ni 2p spectra was measured after removing the native oxides by argon sputtering, which are respectively shown in FIGS. 9C and 9D. The binding energy positions of metallic copper and nickel peaks could be clearly compared, because oxide signals were hardly observable in this case.

It was noteworthy that the copper peaks did not show a considerable change in their positions, while there was a gradual shift of the nickel peak in the negative direction with increasing copper content in the foam. This result indicates that copper supplies electrons to nickel in the copper-nickel alloy foam, which matches well with the trend in electronegativity; nickel has higher electronegativity than copper, although the difference is insignificant. The electrons provided from copper to nickel would then suppress the oxidation of nickel and also dissolution of nickel in the form of cation. Given that the standard potential of nickel or $Ni^{2+}$ is significantly lower than that of copper or $Cu^{2+}$ by 0.6 volts, it can be easily expected that nickel first oxidizes or dissolves prior to copper they are in direct contact.

Therefore, the high corrosion resistance of copper-nickel alloy foam can be attributed to the electronic interaction between copper and nickel. The negative shift of metallic nickel peak was also observable at the surface of the alloy foam in FIG. 9B, indicating that the electronic interaction is significant at the surface, where the actual corrosion occurs.

Typical compressive stress-strain curves are shown in FIG. 10A for the Cu7Ni3, Cu5Ni5, and Cu3Ni7 alloy foams with pore orientation parallel to the load axis. The alloy foam samples tended to follow typical the ductile metallic behavior with linear elasticity at low stresses followed by a collapse plateau, which eventually leads to a densification region in stress that rises steeply. Here, it is noted that the directionality with respect to the loading axis is important for these directionally solidified metal foams.

For example, metal foams with their pores normal to the loading axis yield at about one third of the yield stress of the foams with the pores parallel to the loading axis due to bending being the major deformation mode of the walls as opposed to the plastic buckling of the latter. Strain-hardening behavior is seen for all the three alloy foams in the plastic region of 10 percent strain for Cu7Ni3 foam and up to about 35 percent strain for Cu5Ni5 and Cu3Ni7 foams, where the stress then dramatically decreased. Even with the presence of possible cracks and fractures inside the foam, the 3-D connected struts in the foams could probably withstand high stresses and finally have high compressive strengths up to near complete deformation. The Cu7Ni3 alloy foam has about a 53 percent porosity plus or minus about 2 percent porosity, thus resulting in the relatively higher yield strength of 72 megapascals plus or minus about 2 megapascals, whereas the Cu5Ni5 and Cu3Ni7 alloy foams have about 67 percent porosity plus or minus about 2 percent porosity and 73 percent porosity plus or minus about 2 percent porosity, resulting in the lower yield strengths of 29 megapascals plus or minus about 2 megapascals and 14 megapascals plus or minus about 2 megapascals, respectively. Therefore, stress normalization $\sigma$ divided by $(A(\rho^*)^{1.5})$ was carried out to compare the strength of the alloy foams in terms of their compositions alone, with their differences in porosity being excluded (FIG. 10B).

For the normalization, the Gibson-Ashby (G-A) model was used to predict the strength of porous material as presented in an equation, $$\frac{\sigma^*}{\sigma_S} = A\left(\frac{\rho}{\rho_S}\right)^{1.5},$$

where A is a constant equal to 0.3 for metal and $\sigma_s$ and $\rho_s$ are the yield strength and density of the corresponding bulk material, respectively. A value of measured yield strength was taken for $\sigma^*$ and a measured value of relative density was also taken for $\rho$ divided by $\rho_s$ in the G-A equation. Even after normalization, the normalized strength ($\sigma_s$) of Cu7Ni3 foam was still the largest with a value of about 852 megapascals plus or minus about 3 megapascals, and that of the Cu3Ni7 foam was the smallest, with a value of 418 megapascals plus or minus about 2 megapascals.

FIG. 11 shows that the energy absorbed by the foams during compression to a strain of 0.4 is higher for the Cu7Ni3, Cu5Ni5, and Cu5Ni5 alloy foams than the pure copper and nickel foams, which can be explained by their solid-solution alloying effects.

Nanoindentation testing was carried out to determine the elastic modulus and hardness of the struts of all seven synthesized copper-nickel alloy foams. FIG. 12A displays a representative curve of the force versus displacement for the Cu5Ni5 alloy foam with the calculated results of the elastic modulus and hardness values directly obtained from the unloading curve and the peak force value where the peak load is 120 micronewtons.

The hardness (H) and elastic modulus (E) values of the pure nickel and copper foams along with those of the five copper-nickel alloy foams are compared in FIG. 12B. The dependence of E and H on the composition of nickel is clearly seen with their values varying in the range of about 73.4-152.4 gigapascals and about 1.6-4.7 gigapascals, respectively.

Indeed, both the H and E of the pure and alloy foams vary in a similar manner; in other words, they both tend to increase with increasing degree of alloying. In particular, both the E and H are larger for the Cu5Ni5, Cu7Ni3 and Cu3Ni7 alloy foams than those for the pure copper and nickel foams. With the E value of the Cu5Ni5 alloy foam being only slightly higher, all three alloy foams show similarly higher E values than pure copper and nickel foams. On the other hand, the H value of the Cu5Ni5 alloy foam is clearly superior to those of the Cu7Ni3 and Cu3Ni7 alloy foams and pure copper and nickel foams.

A table below describes heat-treatment processing parameters and the main microstructural features of strut size, pore size, and porosity for the pure copper and nickel foams compared with the Cu9Ni1, Cu7Ni3, Cu5Ni5, Cu3Ni7, Cu1Ni9 alloy foams.

TABLE

| | Heat Treatment (Under H2 Gas) | Strut Size (Microns) | Pore Size (Microns) | Porosity (%) |
|---|---|---|---|---|
| Cu | 250° C., 2 h → 800° C., 6 h | 1.45 ± 0.38 | 1.48 ± 0.36 | 64.7 |
| Cu9Ni1 | 300° C., 2 h → 900° C., 8 h | 1.36 ± 0.33 | 1.28 ± 0.35 | 55.8 |
| Cu7Ni3 | 300° C., 2 h → 900° C., 8 h | 0.95 ± 0.32 | 1.13 ± 0.23 | 55.2 |

TABLE-continued

| | Heat Treatment (Under H2 Gas) | Strut Size (Microns) | Pore Size (Microns) | Porosity (%) |
|---|---|---|---|---|
| Cu5Ni5 | 300° C., 2 h → 900° C., 8 h | 0.74 ± 0.17 | 0.85 ± 0.17 | 54.5 |
| Cu3Ni7 | 300° C., 2 h → 900° C., 8 h | 0.72 ± 0.24 | 1.20 ± 0.41 | 61.3 |
| Cu1Ni9 | 300° C., 2 h → 900° C., 8 h | 0.60 ± 0.13 | 0.96 ± 0.30 | 62.2 |
| Ni | 300° C., 2 h → 1000° C., 6 h | 0.73 ± 0.18 | 1.99 ± 0.41 | 60.1 |

Three dimensionally (3-D) connected copper-nickel alloy foams with five different compositions are successfully fabricated using a combination of CuO—NiO oxide powder mixing, freeze casting, and reduction or sintering process, or both, by utilizing their high-temperature alloying mechanism. The manufactured copper-nickel alloy foams have a porosity of about 50 percent to about 90 percent with open pore structure, and can thus provide large surface area and high permeability for various functional applications such as high-temperature filters, corrosion-resistant electrodes, and highly wear-resistant bulk alloys or composites when infiltrated with other materials.

The copper-nickel alloy foam as described above where the starting material is a mixture of nickel oxide (NiO) power (with the average size of about 10-1,000 nanometers) and copper oxide (CuO) power (with the average size of about 10-1,000 nanometers) mixed with water (or other liquid solvent), binder, and dispersant (Darvan). For better dispersion, the slurry solution is stirred for 10-30 minutes and then sonicated for 30-60 minutes.

The copper-nickel alloy foam as described above where the starting powder mixture of nickel oxide and copper oxide is mechanically mixed in a mixing machine for 10-60 minutes to obtain a uniform particle mixing, prior to being mixed with water, binder, and dispersant for slurry preparation.

The copper-nickel alloy foam as described above where the synthesis method is a combination of the slurry freezing or drying, or both, and thermal reduction or sintering, or both, methods. This invented process includes the low-temperature freezing (about −50 degrees Celsius to −10 degrees Celsius) or drying, or both, of the prepared CuO—NiO powder slurry as described above to make CuO—NiO foam green body. The CuO—NiO foam green body is then subjected to a simultaneous low-temperature reduction (about 250-300 degrees Celsius in a furnace under a 5 percent argon, hydrogen gas mixture) and sintering (about 700-1,100 degrees Celsius in a furnace under a 5 percent argon, hydrogen gas mixture) processes for the complete transformation to copper-nickel alloy foam, resulting in a 3-D pore structure with uniformly distributed pores typically several to tens of microns in diameter and occasional nanometer pores (a few tens to several hundreds of nanometers).

The copper-nickel alloy foam as described above where the cooling rate is less than about 2-5 degrees Celsius per minute. The lower cooling rate (less than about 3 degrees Celsius) is generally preferred for larger copper-nickel alloy foam samples to prevent them from cracking during cooling.

The copper-nickel foam as described above where the invented manufacturing process applies to various copper-nickel foams including Cu9Ni1, Cu7Ni3, Cu5Ni5, Cu3Ni7, and Cu1Ni9, depending on their target applications. The copper-nickel foams with various compositions are obtainable as copper and nickel can form a solid solution during the high-temperature sintering. Therefore, the processing routes described in this patent can also apply to other alloy foams that can form partial or complete solid solutions at elevated temperature.

In an implementation, a composition of matter include a three dimensionally connected copper-nickel alloy foam of Cu9Ni1, Cu7Ni3, Cu5Ni5, Cu3Ni7, or Cu1Ni9. The composition can have a porosity from about 50 percent to about 90 percent with an open pore structure. The copper-nickel alloy foam can have a cooling rate of less than about 2 to about 5 Celsius per minute, or about less than about 3 Celsius per minute, which will improve resistance against cracking during cooling.

In an implementation, a method include: mixing copper oxide powder and nickel oxide powder to obtain a slurry solution; freeze casting the slurry solution of copper oxide powder and nickel oxide powder; reducing or sintering, or both, the freeze-casted slurry of copper oxide and nickel oxide powder at a high temperature; and after the reducing or sintering, producing a three dimensionally connected copper-nickel alloy foam of Cu9Ni1, Cu7Ni3, Cu5Ni5, Cu3Ni7, or Cu1Ni9.

The nickel oxide powder can have an average size of about 10 to about 1000 nanometers. The copper oxide powder can have an average size of about 10 to about 1000 nanometers.

The copper oxide powder and nickel oxide powder can be mixed in water or other liquid solvent with a binder and a dispersant. The binder can be polyvinyl alcohol. The dispersant can be sodium polyacrylate powder. The method can include stirring the slurry solution for about 10 to 30 minutes; and after the stirring, sonicating the slurry solution for about 30-60 minutes. Also, the method can include mechanically mixing the copper oxide powder and nickel oxide powder for about 10-60 minutes to obtain a uniform particle mixing before mixing with water, binder, and dispersant.

The method can include freezing the slurry at a temperature from about −50 degrees Celsius to about −10 degrees Celsius to obtain a foam green body of a composition of copper oxide and nickel oxide. The method can include drying the slurry at a temperature from about −50 degrees Celsius to about −10 degrees Celsius to obtain a foam green body of composition of copper oxide and nickel oxide.

The method can include reducing the foam green body of the composition copper oxide and nickel oxide at a temperature from about 250 degrees Celsius to about 300 degrees Celsius in an about 5 percent argon, hydrogen gas mixture. The method can include after reducing, sintering the foam green body of the composition of copper oxide and nickel oxide at a temperature from about 700 degrees Celsius to about 1100 degrees Celsius in an about 5 percent argon, hydrogen gas mixture. The foam green body of the composition of copper oxide is transformed into the copper-nickel alloy foam.

The resulting copper-nickel alloy foam will have a three-dimensional pore structure with uniformly distributed pores having diameters from about 2 microns to about 100 microns. The three-dimensional pore structure can also include some nanometer pores having diameters from about 10 nanometers to about 400 nanometers in diameter.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

This invention claimed is:

1. A method comprising:

mixing copper oxide powder and nickel oxide powder to obtain a slurry solution, wherein the nickel oxide powder has an average size of about 10 nanometers to less than about 20 nanometers;

freeze casting the slurry solution of copper oxide powder and nickel oxide powder;

reducing or sintering, or both, the freeze-casted slurry of copper oxide powder and nickel oxide powder at a temperature of about 800 degrees Celsius to about 1000 degrees Celsius; and after the reducing or sintering, producing a three-dimensionally connected copper-nickel alloy foam of at least one of Cu9Ni1, Cu7Ni3, Cu5Ni5, Cu3Ni7, or Cu1Ni9.

2. A method comprising:

mixing copper oxide powder and nickel oxide powder to obtain a slurry solution, wherein the copper oxide powder has an average size of about 40 nanometers to about 80 nanometers, and the nickel oxide powder has an average size of about 10 nanometers to less than about 20 nanometers;

freeze casting the slurry solution of copper oxide powder and nickel oxide powder;

reducing or sintering, or both, the freeze-casted slurry of copper oxide powder and nickel oxide powder at a temperature of about 800 degrees Celsius to about 1000 degrees Celsius; and after the reducing or sintering, producing a three-dimensionally connected copper-nickel alloy foam of at least one of Cu9Ni1, Cu7Ni3, Cu5Ni5, Cu3Ni7, or Cu1Ni9.

3. The method of claim 1 wherein the copper oxide powder and nickel oxide powder are mixed in water or other liquid solvent with a binder and a dispersant.

4. The method of claim 3 wherein the binder is polyvinyl alcohol and the dispersant is sodium polyacrylate powder.

5. The method of claim 3 comprising:

stirring the slurry solution for from about 10 minutes to about 30 minutes; and after the stirring, sonicating the slurry solution for about 30 minutes to about 60 minutes.

6. The method of claim 1 comprising:

mechanically mixing the copper oxide powder and nickel oxide powder for from about 10 minutes to about 60 minutes to obtain a uniform particle mixing before mixing with water, binder, and dispersant.

7. The method of claim 1 comprising:

freezing the slurry at a temperature from about −50 degrees Celsius to about −10 degrees Celsius to obtain a foam green body of a composition of copper oxide and nickel oxide.

8. The method of claim 1 comprising:

drying the slurry at a temperature from about −50 degrees Celsius to about −10 degrees Celsius to obtain a foam green body of composition of copper oxide and nickel oxide.

9. The method of claim 7 comprising:

reducing the foam green body of the composition of copper oxide and nickel oxide at a temperature from about 250 degrees Celsius to about 350 degrees Celsius in an about 5 percent argon and hydrogen gas mixture.

10. The method of claim 9 comprising:

after reducing, sintering the foam green body of the composition of copper oxide and nickel oxide at a temperature from about 700 degrees Celsius to about 1100 degrees Celsius in an about 5 percent argon and hydrogen gas mixture, thereby transforming the foam green body of the composition of copper oxide into the copper-nickel alloy foam.

11. The method of claim 10 wherein the copper-nickel alloy foam comprises a three-dimensional pore structure with uniformly distributed pores having diameters from about 2 microns to about 100 microns.

12. The method of claim 11 wherein the three-dimensional pore structure also comprises some nanometer pores having diameters from about 10 nanometers to about 400 nanometers.

13. The method of claim 1 wherein the copper-nickel alloy foam comprises a three-dimensional pore structure with uniformly distributed pores having diameters from about 2 microns to about 100 microns.

14. The method of claim 2 wherein the copper-nickel alloy foam comprises a three-dimensional pore structure with uniformly distributed pores having diameters from about 2 microns to about 100 microns.

15. The method of claim 2 wherein the copper oxide powder and nickel oxide powder are mixed in water or other liquid solvent with at least one of polyvinyl alcohol or sodium polyacrylate powder, and the method comprises stirring the slurry solution for about 10 minutes to about 30 minutes, and after the stirring, sonicating the slurry solution for about 30 minutes to about 60 minutes.

16. A method comprising:

mixing copper oxide powder and nickel oxide powder to obtain a slurry solution, wherein the nickel oxide powder has an average size of about 10 nanometers to less than about 20 nanometers;

freeze casting the slurry solution of copper oxide powder and nickel oxide powder;

reducing or sintering, or both, the freeze-casted slurry of copper oxide powder and nickel oxide powder; and after the reducing or sintering, producing a three-dimensionally connected copper-nickel alloy foam of at least one of Cu9Ni1, Cu7Ni3, Cu5Ni5, Cu3Ni7, or Cu1Ni9.

17. The method of claim 16 wherein the copper oxide powder comprises an average size of about 40 nanometers to about 80 nanometers.

18. The method of claim 16 wherein the copper oxide powder and nickel oxide powder are mixed in water or other liquid solvent with polyvinyl alcohol.

19. The method of claim 16 wherein the copper oxide powder and nickel oxide powder are mixed in water or other liquid solvent with sodium polyacrylate powder.

20. The method of claim 16 comprising:

mixing the copper oxide powder and nickel oxide powder for from about 10 minutes to about 60 minutes to obtain a uniform particle mixing;

stirring the slurry solution from about 10 minutes to about 30 minutes; and after the stirring, sonicating the slurry solution from about 30 minutes to about 60 minutes.

21. The method of claim 20 wherein the freeze casting comprises freezing the slurry at a temperature from about −50 degrees Celsius to about −10 degrees Celsius to obtain a foam green body of a composition of copper oxide and nickel oxide, drying the slurry at a temperature from about −50 degrees Celsius to about −10 degrees Celsius to obtain a foam green body of composition of copper oxide and nickel oxide.

22. The method of claim 16 wherein the reducing or sintering, or both, comprises reducing the foam green body of the composition of copper oxide and nickel oxide at a temperature from about 250 degrees Celsius to about 350 degrees Celsius in an about 5 percent argon and hydrogen gas mixture, and after reducing, sintering the foam green body of the composition of copper oxide and nickel oxide at a temperature from about 700 degrees Celsius to about 1100 degrees Celsius in an about 5 percent argon and hydrogen gas mixture, thereby transforming the foam green body of the composition of copper oxide in the copper-nickel alloy foam.

23. The method of claim 16 wherein the three-dimensional pore structure comprises pores having diameters from about 10 nanometers to about 400 nanometers.

24. A method comprising:

mixing copper oxide powder and nickel oxide powder to obtain a slurry solution, wherein the nickel oxide powder has an average size of about 10 nanometers to less than about 20 nanometers;

freeze casting the slurry solution of copper oxide powder and nickel oxide powder;

reducing or sintering, or both, the freeze-casted slurry of copper oxide powder and nickel oxide; and after the reducing or sintering, producing a three-dimensionally connected copper-nickel alloy foam of at least one of Cu9Ni1, Cu7Ni3, Cu5Ni5, Cu3Ni7, or Cu1Ni9, wherein the copper oxide powder and nickel oxide powder are mixed in water or other liquid solvent with a binder and a dispersant;

mechanically mixing the copper oxide powder and nickel oxide powder for from about 10 minutes to about 60 minutes to obtain a uniform particle mixing before mixing with water, the binder, and the dispersant;

stirring the slurry solution from about 10 minutes to about 30 minutes;

after the stirring, sonicating the slurry solution from about 30 minutes to about 60 minutes;

freezing the slurry at a temperature from about −50 degrees Celsius to about −10 degrees Celsius to obtain a foam green body of a composition of copper oxide and nickel oxide;

drying the slurry at a temperature from about −50 degrees Celsius to about −10 degrees Celsius to obtain a foam green body of composition of copper oxide and nickel oxide;

reducing the foam green body of the composition copper oxide and nickel oxide at a temperature from about 250 degrees Celsius to about 350 degrees Celsius in an about 5 percent argon and hydrogen gas mixture; and after reducing, sintering the foam green body of the composition of copper oxide and nickel oxide at a temperature from about 700 degrees Celsius to about 1100 degrees Celsius in an about 5 percent argon and hydrogen gas mixture, thereby transforming the foam green body of the composition of copper oxide into the copper-nickel alloy foam.

* * * * *